US005512113A

United States Patent [19]

Short et al.

[11] Patent Number: 5,512,113

[45] Date of Patent: Apr. 30, 1996

[54] ONE-PIECE SINGLE METAL SPINNERET HAVING SOFTENED CAPILLARY ZONE

[75] Inventors: Mark A. Short, Ridgeway; Thomas E. Willis, Midlothian, both of Va.

[73] Assignee: E. I. Du Pont de Nemours and Company, Wilmington, Del.

[21] Appl. No.: 152,666

[22] Filed: Nov. 9, 1993

[51] Int. Cl.[6] ..... B29F 3/04; C21D 1/04

[52] U.S. Cl. ..... 148/565; 425/461; 425/464; 425/382.2

[58] Field of Search ..... 148/565; 425/461, 425/464, 382.2

[56] References Cited

U.S. PATENT DOCUMENTS

| | | | |
|---|---|---|---|
| 1,791,785 | 2/1931 | Austin | 148/281 |
| 4,054,468 | 10/1977 | Honnaker et al. | 148/220 |
| 4,137,032 | 1/1979 | Honnaker et al. | 425/464 |
| 5,168,143 | 12/1992 | Kobsa | 219/121.72 |

FOREIGN PATENT DOCUMENTS

| | | | |
|---|---|---|---|
| 28490590A5 | of 0000 | Germany . | |
| 702936 | 1/1954 | United Kingdom | 425/464 |

*Primary Examiner*—Sikyin Ip

[57] ABSTRACT

A one-piece single metal spinneret is disclosed having a capillary zone with capillaries of a length more than 1.5 times the capillary diameter and a yield strength, outside the capillary zone, of greater than 350 MPa. A process for making the spinneret is, also, disclosed.

5 Claims, 1 Drawing Sheet

ONE-PIECE SINGLE METAL SPINNERET HAVING SOFTENED CAPILLARY ZONE

BACKGROUND OF THE INVENTION

1. Field of the Invention

Spinnerets with very small capillaries made from corrosion resistant materials have long been sought by producers of some fiber products. For example, aramids (such as poly(p-phenylene terephthalamide)) are often spun from hot concentrated sulfuric acid solution and require spinnerets of corrosion resistant material.

2. Description of the Prior Art

U.S. Pat. No. 4,054,468 (Honnaker et al.) discloses a corrosion-resistant spinneret and a process for making such a spinneret by forming and machining a laminate comprising a support body of stainless steel or tantalum alloy and a face layer of pure tantalum metal which has been explosively bonded to the support body. The process requires machining of the support body of the spinneret blank, drilling counterbores through the support body and partially into the face layer, forming spinneret capillaries from the counterbores through the face layer to the exit face of the spinneret, polishing the face to remove protrusions, and hardening the face by heat-treatment in nitrogen. The spinnerets of that patent require two-layer materials.

SUMMARY OF THE INVENTION

The present invention provides a spinneret comprising a one-piece single metal body having an entrance face and an exit face with at least one spinning passage extending from the entrance face to the exit face wherein the spinning passage includes a lead hole extending from the entrance face into the metal body and a capillary extending through a capillary zone from the exit face into the metal body to a point of connection with the lead hole wherein the metal in the capillary zone is softer than the metal in the remainder of the body, the cross-sectional area of the lead hole is greater than the cross-sectional area of the capillary, and the length of the capillary is more than 2 times its diameter. The diameter of the capillary is generally less than 0.15 millimeter.

The present invention provides a process for making a spinneret from a one-piece single metal body having an entrance face and an exit face comprising the steps of forming at least one lead hole from the entrance face into the body, forming at least one capillary from the exit face into the body and connecting with the lead hole, and, prior to forming the capillary, annealing only a capillary zone of the body extending over the length of the capillary to the exit face by heating only the capillary zone to a temperature above the recrystallization temperature and below the melting point of the metal.

BRIEF DESCRIPTION OF THE INVENTION

FIG. 1 is a vertical cross-sectional view of a cup-shaped spinneret embodiment of this invention. FIG. 2 is an enlarged cross-sectional view of a portion of the spinneret of FIG. 1 which includes a single spinning passage.

DETAILED DESCRIPTION OF THE INVENTION

Figure 1:
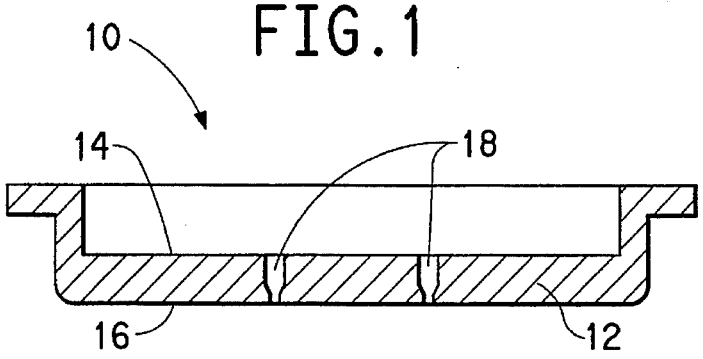

Referring to FIG. 1, spinneret 10, shown in cross-section, is composed of a single metal body 12 with an entrance face 14 and an exit face 16. The single metal body 12 can be fabricated using any metal of adequate strength. Some of the metals eligible for use in constructing spinnerets of this invention are listed in Table I, along with important properties of those metals. Spinneret metals are commonly selected based on acceptable corrosion resistance and sufficient yield strength to withstand the stresses of the intended use.

Metals preferred for spinnerets of this invention exhibit a low corrosion rate, such as 0.025 millimeter/year or less in the environment of intended use. Low corrosion rates are necessary because of the small size of the capillary and the small mechanical tolerances required to insure fiber uniformity. Strength requirements for materials of spinneret construction are such that stresses applied to the spinneret must be below the yield strength of the material during use in order to avoid permanent damage. Spinnerets of this invention may be of plate, disc, flat-bottomed or radius-bottomed cup type having round or non-round cross-section.

A metal can be hardened, and thereby strengthened, by "work hardening". Work hardening is accomplished by deforming a metal beyond its yield point. Cold rolling is a common controlled method of work hardening resulting in increased yield strength and hardness. Work hardening can be produced by any operation that plastically deforms the metal.

A metal can be softened or annealed by heating it to the appropriate above the recrystallization temperature and below the melting temperature of the metal and cooling as required to achieve the desired change in properties. Metals that have been hardened by work hardening can be softened by performing an annealing heat treatment.

It has generally been determined that metals eligible for use in spinnerets of this invention, provided that other requirements such as adequate corrosion resistance have been met, will exhibit a hardened yield strength of greater than about 350 MPa and preferably greater than 450 MPa and a hardness of greater than about HRB 85 and preferably greater than HRB 90 (Rockwell Hardness, "B" scale). In the softened or annealed condition, those metals will exhibit a yield strength of less than about 350 MPa and preferably less than 250 MPa and a hardness of less than about HRB 85, and preferably less than HRB 75.

For aramid fiber production—spinning concentrated sulfuric acid dopes—the preferred spinneret metals are commercial grade "pure" tantalum and tantalum alloyed with 2 to 3 percent of tungsten. Tantalum metal and alloys of this type which also contain a grain refining agent, such as niobium, are eligible but are less desirable because machining is more difficult. Alloys of tantalum containing up to 15 percent by weight of tungsten may be used but are, also, difficult to machine, and drilling results in high tool wear. Stainless steels having the required yield strength, elongation, and corrosion resistance may also be employed. Materials other than tantalum can be used for concentrated sulfuric acid dopes so long as they have corrosion resistance and annealed yield strengths of less than 350 MPa. Some such materials are listed in Table I.

Spinneret 10 generally has many spinning passages 18—from tens to hundreds and even thousands, in some cases.

Figure 2:
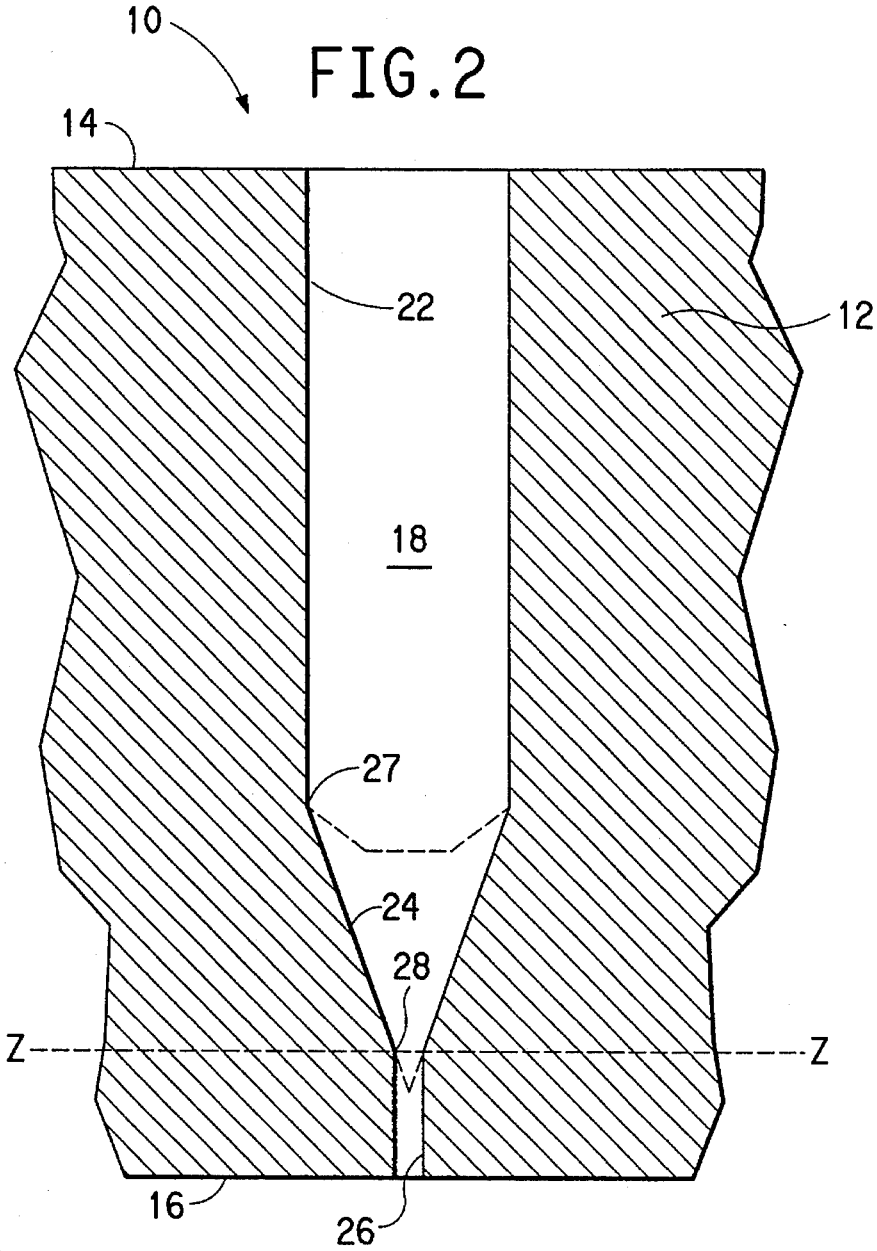

FIG. 2 represents an enlargement of a portion of spinneret 10 from FIG. 1. Spinning passage 18 through metal body 12 is shown in greater detail. Spinning passage 18 is constructed in three parts. Lead hole 22 is the relatively large diameter portion of spinning passage 18 which extends from entrance face 14 into the body 12; and capillary 26 is the relatively small diameter portion of spinning passage 18 which extends from exit face 16 into the body 12. Lead hole 22 ends with tapered hole 24 which extends from the inner portion of lead hole 22 at 27 to the inner end of capillary 26 at 28. The diameter of lead hole 22 is generally about 0.6 millimeters and may range from 0.5 to 7 millimeters. Capillary 26 may be of round or other cross-section; and generally has a diameter or shortest side-to-side cross-section dimension of about 0.065 millimeters and may range from 0.01 to 4 millimeters. Tapered hole 24 can be of conical or other shape, generally has a total angle of 45 degrees, and may range from 20 to 120 degrees. The major diameter of lead hole 22 is at least two times the diameter of the capillary and is usually at least 8 times the diameter of the capillary.

The dimensions and ratios provided herein with regard to the elements of the spinnerets of this invention are understood to be the usual case, especially with regard to spinnerets used to spin concentrated sulfuric acid dopes, and are not intended to limit the spinnerets in any way.

Capillary 26 is generally about 0.18 millimeters in length and may range from 0.04 to 7 millimeters in length. Punching capillaries into metal becomes increasingly difficult as the capillary diameter decreases and such punching is dramatically more difficult when the length of the capillary to be punched is more than 2 times the capillary diameter. The ratio of capillary length to diameter is termed the L/D. This invention finds use in any spinneret made from a single piece of metal; but there is special benefit when the capillary L/D is more than 1.5. Capillary diameter means diameter in the case of a capillary of round cross-section; and, in the case of a capillary of non-round cross section, the shortest side-to-side dimension of the cross section.

As has been stated, the spinnerets of this invention are made from a single piece of metal without additional bonded layers wherein the untreated metal is too hard to be effectively punched or drilled with capillaries. It has been discovered that a thin volume of the spinneret body can be annealed to cause a closely-controlled, localized, softening of the metal to permit punching the capillaries. The annealing is conducted in the thickness of the spinneret body from the exit face to the inner end of the capillary 28, hereinafter called the capillary zone. The capillary zone is depicted in FIG. 2 as the volume of the spinneret extending from line Z—Z to exit face 16 and extends over the length of the capillaries to the exit face. The capillary zone can, of course, include somewhat more or less than the entire length of the capillaries; but the reason for the capillary zone must be kept in mind—that is, to afford a softened metal in which to form capillaries. By this annealing process, the capillary zone can be softened while maintaining the hardness and the strength in the remainder of the spinneret which is required for successful and reliable operation.

The localized annealing can be accomplished by directing a concentrated energy beam onto the exit face of the spinneret to raise the temperature of the capillary zone above the recrystallization temperature but not up to the melting temperature of the metal. By adjusting the focus and energy of the beam, the desired depth of annealing can be controlled to affect only the capillary zone. The preferred method is to use an electron beam, but a laser beam can also be employed. Electron beam heating is a well-known means for heating metals. A description of electron beam heating can be found in the Metals Handbook, 8th Ed. Vol. 6, "Welding and Brazing", by the American Society for Metals (1971), pages 519–564.

To make a spinneret of this invention, lead holes of appropriate size are drilled or formed into the entrance face of a spinneret blank to the desired distance from the exit face and the tapered holes are drilled or formed, thereafter. As an optional step, the entrance and exit faces can be polished to flatness after making these holes.

Before forming the capillaries from the tapered holes to the exit face, the capillary zone at the exit face must be softened by annealing using a focused high-energy beam. The annealing can be done before or after the lead holes and the tapered holes have been made. It has been found to be convenient to perform the annealing before making the holes so that the hole and capillary forming operations can be completed without interruption. The annealing can be conducted by scanning a focused, high-energy, beam on the exit face of the spinneret blank in such a way as to raise the temperature of the blank, at the exit face and through the capillary zone, to above the recrystallization or annealing temperature of the metal, and below the melting temperature of the metal. For tantalum and tantalum alloys, the recrystallization temperature is about 1250° C. Recrystallization and melting temperatures of other eligible metals are shown in Table I. When using electron beam energy on tantalum and tantalum alloys, it has been found effective to focus a 120 kilowatt 10 milliamp beam to a 1.5 millimeter diameter and scan the spinneret blank with a 0.75 millimeter overlap on each pass at an appropriate scan rate to reach the desired temperature. This combination of beam power, beam focus, and scan rate has been found appropriate to achieve an annealed capillary zone about 0.75 millimeters thick in tantalum. Beam energy and scan rate may be adjusted for use with other metals.

Some metals, when annealed in air, suffer discoloration and oxidation. For that reason, it is preferred but optional that the annealing process should be conducted in a vacuum or in an inert gas atmosphere.

Once the annealing has been completed and the holes have been made, the capillaries are formed through the spinneret blank from the base of the tapered hole to the exit face. Capillary forming can be accomplished by means of a punching tool made from a strong, wear-resistant material, such as tungsten carbide or tool steel, in the same size and shape as the desired capillaries. In some instances, capillaries may, also, be drilled and the aim is the same— to form an extremely small hole in a hard metal. For the purpose of this invention, forming capillaries includes drilling capillaries. After capillary formation, it is often desirable to polish the exit face of the spinneret to remove any burrs or irregularities.

TABLE I

PROPERTIES OF SOME SPINNERET METALS

| METAL | | | | | | | |
|---|---|---|---|---|---|---|---|
| UNS** | COMMON | Ta (°C.) | Tm (°C.) | Ha (HRB) | Hh (HRB) | Sa (MPa) | Sh (MPa) |
| R05210 | TA (Pure) | 1250 | 2996 | 50 | 90 | 207 | 483 |
| | 97.5% TA/ 2.5% W | 1350 | 3020 | 64 | 98 | 310 | 621 |
| | 70% AU/ 30% PT | 1100 | 1450 | 64 | 86 | 207 | 552 (60%) |
| | 80% PT/ 20% RH | 1000 | 1895 | 67 | 95 | 241 | 552 (75%) |
| | 87.5% PT/ 12.5% IR | 1400 | 1800 | 78* | 94* | 241 | 415 |

TABLE I-continued

PROPERTIES OF SOME SPINNERET METALS

| METAL | | | | | | | |
|---|---|---|---|---|---|---|---|
| UNS** | COM-MON | Ta (°C.) | Tm (°C.) | Ha (HRB) | Hh (HRB) | Sa (MPa) | Sh (MPa) |
| N02200 | | 815 | 1440 | 45 | 100 | 344 | 689 |
| R50400 | | 950 | 1672 | 65 | 90* | 207 | 483 |
| N06625 | | 1200 | 1315 | 65 | 100 | 310 | 758 (20%) |
| S31600 | 316 SS | 1066 | 1385 | 82 | — | 241 | 689 (40%) |

*Number interpolated or estimated from existing data.
**Unified Numbering System (UNS) Material Designation, as established by ASTM E 527-83.
Ta = annealing (recrystallization) temperature.
Tm = melting temperature.
Ha = hardness in the annealed condition.
Hh = hardness in the hardened condition.
Sa = yield strength in the annealed condition.
Sh = yield strength in the hardened condition.
HRB = Rockwell "B" hardness number.
NOTE:
Percent coldwork (reduction in cross section by plastic deformation) required to harden material to the strength/hardness listed is noted in parentheses next to Sh if known.

We claim:

1. A spinneret comprising a one-piece single metal body having:

(a) an entrance face, and (b) an exit face with (c) at least one spinning passage extending from the entrance face to the exit face wherein the spinning passage includes a lead hole with a cross-sectional area and extends for a length from the entrance face into the metal body and a capillary with a cross-sectional area and extends for a length through a capillary zone from the exit face into the metal body to a point of connection with the lead hole, wherein the metal in the capillary zone is softer and has a yield strength which is less than the metal in the remainder of the body and wherein the cross-sectional area of the lead hole is greater than the cross-sectional area of the capillary, and the length of the capillary is more than 1.5 times the diameter of the capillary.

2. The spinneret of claim 1 wherein the yield strength of the metal from the entrance face to the capillary is greater than 350 MPa.

3. The spinneret of claim 1 wherein the metal of the body includes tantalum.

4. The spinneret of claim 2 wherein the yield strength of the metal in the capillary zone is less than 350 MPa.

5. The spinneret of claim 4 wherein the metal of the capillary zone has a hardness of less than HRB 85 and the metal of the remainder of the body has a hardness of greater than HRB 85.

* * * * *